US007338551B2

(12) United States Patent
Kozyuk

(10) Patent No.: US 7,338,551 B2
(45) Date of Patent: Mar. 4, 2008

(54) DEVICE AND METHOD FOR GENERATING MICRO BUBBLES IN A LIQUID USING HYDRODYNAMIC CAVITATION

(75) Inventor: Oleg V. Kozyuk, North Ridgeville, OH (US)

(73) Assignee: Five Star Technologies, Inc., Cleveland, OH (US)

( * ) Notice: Subject to any disclaimer, the term of this patent is extended or adjusted under 35 U.S.C. 154(b) by 99 days.

(21) Appl. No.: 11/243,772

(22) Filed: Oct. 5, 2005

(65) Prior Publication Data

US 2006/0027100 A1 Feb. 9, 2006

Related U.S. Application Data

(63) Continuation-in-part of application No. 10/461,698, filed on Jun. 13, 2003, now abandoned.

(51) Int. Cl.
*B01F 3/04* (2006.01)

(52) U.S. Cl. ..... 95/175; 95/221; 261/28; 261/76; 261/123

(58) Field of Classification Search ..... 95/175, 95/221, 262; 261/28, 29, 76, 36.1, 77, 116, 261/123, DIG. 75

See application file for complete search history.

(56) References Cited

U.S. PATENT DOCUMENTS

| | | | |
|---|---|---|---|
| 2,164,263 | A | 6/1939 | Wall |
| 3,738,620 | A | 6/1973 | Ennis |
| 3,829,247 | A | 8/1974 | Edmonson |
| 3,927,152 | A | 12/1975 | Kyrias |
| 4,152,409 | A | 5/1979 | Nagao et al. |
| 4,162,971 | A | 7/1979 | Zlokarnik et al. |
| 4,198,359 | A | 4/1980 | Todd |
| 4,226,705 | A | 10/1980 | Lecoffre |
| 4,477,341 | A | 10/1984 | Schweiss et al. |
| 4,487,553 | A | 12/1984 | Nagata |
| 4,514,343 | A | 4/1985 | Cramer et al. |
| 4,743,405 | A | 5/1988 | Durao et al. |
| 4,812,049 | A | 3/1989 | McCall |

(Continued)

FOREIGN PATENT DOCUMENTS

| | | |
|---|---|---|
| JP | 2000167575 | 6/2000 |

(Continued)

*Primary Examiner*—Scott Bushey
(74) *Attorney, Agent, or Firm*—Benesch, Friedlander Coplan & Aronoff LLP

(57) ABSTRACT

A device and method for generating micro bubbles in a liquid. The method includes the steps of: providing a flow-through channel containing at least two local constrictions of flow therein; passing the liquid at a velocity of at least at least 12 m/sec through a first local constriction of flow to create a first hydrodynamic cavitation field downstream from the first local constriction of flow; introducing a gas into the liquid in the first local constriction of flow, thereby creating gas-filled cavitation bubbles; collapsing the gas-filled cavitation bubbles formed in the first hydrodynamic cavitation field to dissolve the gas into the liquid, thereby forming a gas-saturated liquid; passing the gas-saturated liquid through a second local constriction of flow to create a second hydrodynamic cavitation field downstream from the second local constriction of flow; and extracting the dissolved gas from the gas-saturated liquid, thereby generating micro bubbles in the liquid.

20 Claims, 3 Drawing Sheets

U.S. PATENT DOCUMENTS 4,964,733 A 10/1990 Fredriksson et al.
5,091,118 A 2/1992 Burgher
5,381,957 A 1/1995 Cianco
5,403,151 A 4/1995 Noyes
5,403,475 A 4/1995 Allen
5,437,784 A 8/1995 Meinecke
5,674,312 A 10/1997 Mazzei
5,783,118 A 7/1998 Kolaini
5,935,490 A 8/1999 Archbold et al.
5,937,906 A 8/1999 Kozyuk
5,951,922 A 9/1999 Mazzei
5,971,601 A * 10/1999 Kozyuk ..... 366/176.1
6,012,492 A 1/2000 Kozyuk
6,035,897 A 3/2000 Kozyuk
6,164,567 A 12/2000 Popov
6,279,611 B2 8/2001 Uematsu et al.
6,460,830 B1 10/2002 Boulant
6,935,770 B2 * 8/2005 Schueler ..... 366/174.1
7,086,777 B2 * 8/2006 Kozyuk ..... 366/176.2
2004/0251566 A1 12/2004 Kozyuk

FOREIGN PATENT DOCUMENTS

WO WO0078466 12/2000

* cited by examiner

DEVICE AND METHOD FOR GENERATING MICRO BUBBLES IN A LIQUID USING HYDRODYNAMIC CAVITATION

RELATED APPLICATION

This application is a continuation-in-part application of U.S. Ser. No. 10/461,698 filed on Jun. 13, 2003, now abandoned.

BACKGROUND

The present invention relates to a device and process for generating micro bubbles in a liquid using hydrodynamic cavitation.

Because micro bubbles have a greater surface area than larger bubbles, micro bubbles can be used in a variety of applications. For example, micro bubbles can be used in mineral recovery applications utilizing the floatation method where particles of minerals can be fixed to floating micro bubbles to bring them to the surface. Other applications include using micro bubbles as carriers of oxidizing agents to treat contaminated groundwater or using micro bubbles in the treatment of waste water.

BRIEF DESCRIPTION OF THE DRAWINGS

In the accompanying drawings which are incorporated in and constitute a part of the specification, embodiments of a device and method are illustrated which, together with the detailed description given below, serve to describe example embodiments of the device and method. It will be appreciated that the illustrated boundaries of elements (e.g., boxes or groups of boxes) in the figures represent one example of the boundaries. Also, it will be appreciated that one element may be designed as multiple elements or that multiple elements may be designed as one element. Furthermore, an element shown as an internal component of another element may be implemented as an external component and vice versa.

Like elements are indicated throughout the specification and drawings with the same reference numerals, respectively. Moreover, the drawings are not drawn to scale and the proportions of certain parts have been exaggerated for convenience of illustration.

DETAILED DESCRIPTION

Figure 1:
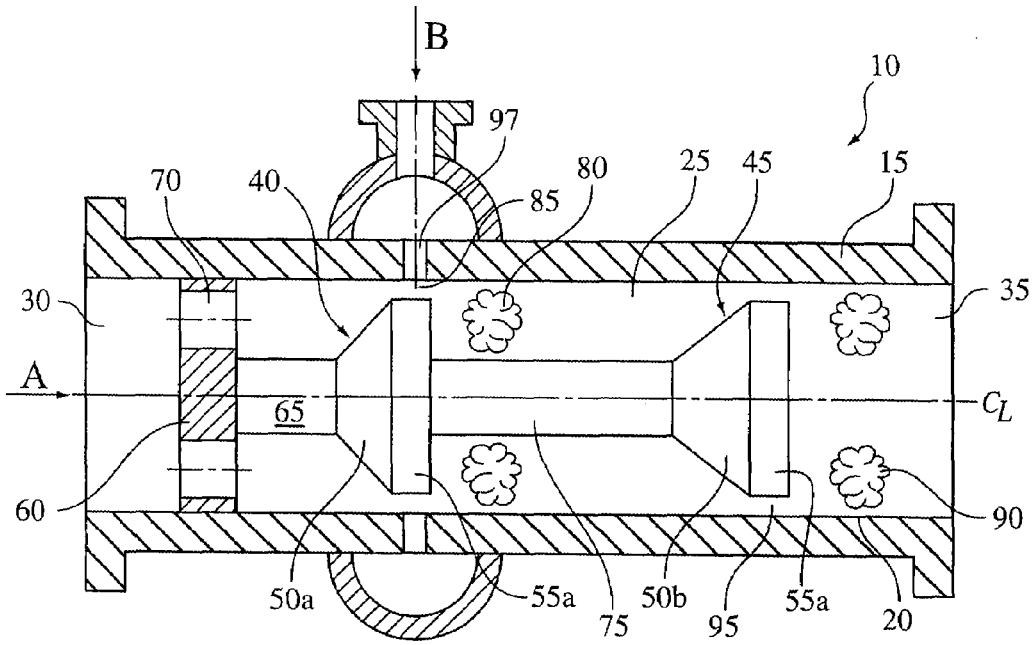
FIG. 1 is a longitudinal cross-section of one embodiment of a hydrodynamic cavitation device 10 for generating micro bubbles in a liquid.

Illustrated in FIG. 1 is a longitudinal cross-section of one embodiment of a hydrodynamic cavitation device 10 for generating micro bubbles in a liquid. The device 10 includes a wall 15 having an inner surface 20 that defines a flow-through channel or chamber 25 having a centerline $C_L$. For example, the wall 15 can be a cylindrical wall that defines a flow-through channel having a circular cross-section. It will be appreciated that the cross-section of flow-through channel 25 may take the form of other geometric shapes such as square, rectangular, hexagonal, or any other complex shape. The flow-through channel 25 can further include an inlet 30 configured to introduce a liquid into the device 10 along a path represented by arrow A and an outlet 35 configured to exit the liquid from the device 10.

With further reference to FIG. 1, in one embodiment, the device 10 can further include multiple cavitation generators that generate a cavitation field downstream from each cavitation generator. For example, the device 10 can include two stages of hydrodynamic cavitation where a first cavitation generator can be a first baffle 40 and a second cavitation generator can be a second baffle 45. It will be appreciated that any number of stages of hydrodynamic cavitation can be provided within the flow-through channel 25. Furthermore, it will be appreciated that other types of cavitation generators may be used instead of baffles such as a Venturi tube, nozzle, orifice of any desired shape, or slot.

In one embodiment, the second baffle 45 is positioned within the flow-through channel downstream from the first baffle 40. For example, the first and second baffles 40, 45 can be positioned substantially along the centerline $C_L$ of the flow-through channel 25 such that the first baffle 40 is substantially coaxial with the second baffle 45.

To vary the degree and character of the cavitation fields generated downstream from the first and second baffles 40, 45, the first and second baffles 40, 45 can be embodied in a variety of different shapes and configurations. For example, the first and second baffles 40, 45 can be conically shaped where the first and second baffles 40, 45 each include a conically-shaped surface 50*a*, 50*b*, respectively, that extends into a cylindrically-shaped surface 55*a*, 55*b*, respectively. The first and second baffles 40, 45 can be oriented such that the conically-shaped portions 50*a*, 50*b*, respectively, confront the fluid flow. It will be appreciated that the first and second baffles 40, 45 can be embodied in other shapes and configurations such as the ones disclosed in U.S. Pat. No. 5,969,207, issued on Oct. 19, 1999, which is hereby incorporated by reference in its entirety herein. Of course, it will be appreciated that the first baffle 40 can be embodied in one shape and configuration, while the second baffle 45 can be embodied in a different shape and configuration.

To retain the first baffle 40 within the flow-through channel 25, the first baffle 40 can be connected to a plate 60 via a shaft 65. It will be appreciated that the plate 60 can be embodied as a disk when the flow-through channel 25 has a circular cross-section, or the plate 60 can be embodied in a variety of shapes and configurations that can match the cross-section of the flow-through channel 25. The plate 60 can be mounted to the inside surface 20 of the wall 15 with screws or any other attachment means. The plate 60 can include a plurality of orifices 70 configured to permit liquid to pass therethrough. It will be appreciated that that a crosshead, post, propeller or any other fixture that produces a minor loss of liquid pressure can be used instead of the plate 60 having orifices 70. To retain the second baffle 45 within the flow-through channel 25, the second baffle 45 can be connected to the first baffle 40 via a stem or shaft 75 or any other attachment means.

In one embodiment, the first and second baffles 40, 45 can be configured to be removable and replaceable by baffles embodied in a variety of different shapes and configurations. It will be appreciated that the first and second baffles 40, 45 can be removably mounted to the stems 65, 75, respectively, in any acceptable fashion. For example, each baffle 40, 45 can threadly engage each stem 65, 75, respectively.

In one embodiment, the first baffle 40 can be configured to generate a first hydrodynamic cavitation field 80 downstream from the first baffle 40 via a first local constriction 85 of liquid flow. For example, the first local constriction 85 of liquid flow can be an area defined between the inner surface 20 of the wall 15 and the cylindrically-shaped surface 55*a* of the first baffle 40. Also, the second baffle 45 can be configured to generate a second hydrodynamic cavitation field 90 downstream from the second baffle 45 via a second local constriction 95 of liquid flow. For example, the second local constriction 95 can be an area defined between the inner surface 20 of the wall 15 and the cylindrically-shaped surface 55*b* of the second baffle 45. Thus, if the flow-through channel 25 has a circular cross-section, the first and second local constrictions 85, 95 of liquid flow can be characterized as first and second annular orifices, respectively. It will be appreciated that if the cross-section of the flow-through channel 25 is any geometric shape other than circular, then each local constriction of flow may not be annular in shape. Likewise, if a baffle is not circular in cross-section, then each corresponding local constriction of flow may not be annular in shape.

In one embodiment, the size of each local constriction 85, 95 is sufficient to increase the velocity of the fluid flow to a minimum velocity necessary to achieve hydrodynamic cavitation (hereafter the "minimum cavitation velocity"), which is dictated by the physical properties of the fluid being processed (e.g., viscosity, temperature, etc.). For example, the size of each local constriction 85, 95, or any local constriction of fluid flow discussed herein, can be dimensioned in such a manner so that the cross-section area of each local constriction of fluid flow would be at most about 0.6 times the diameter or major diameter of the cross-section of the flow-through channel. The minimum cavitation velocity of a fluid is about 12 m/sec. On average, and for most hydrodynamic fluids, the minimum cavitation velocity is about 18 m/sec.

With further reference to FIG. 1, the flow-through channel 25 can further include a port 97 for introducing a gas into the flow-through channel 25 along a path represented by arrow B. For example, the gas can be air, oxygen, nitrogen, hydrogen, ozone, or steam. In one embodiment, the port 97 can be disposed in the wall 15 and positioned adjacent the first local constriction 85 of flow to permit the introduction of the gas into the liquid in the first local constriction 85 of flow. For example, the gas can be introduced into the liquid in a region of reduced liquid pressure in the first local constriction 85 of flow. It will be appreciated that the port 97 can be disposed in the wall 15 anywhere along the axial length first local constriction 85 of flow. Furthermore, it will be appreciated that any number of ports can be provided in the wall 15 to introduce gas into the first local constriction 85 or the port 97 can be embodied as a slot to introduce gas into the first local constriction 85.

In operation of the device 10 illustrated in FIG. 1, the liquid enters the flow-through channel 25 via the inlet 30 and moves through the orifices 70 in the plate 60 along the fluid path A. The liquid can be fed through the flow-through channel 25 and maintained at any flow rate sufficient to generate a hydrodynamic cavitation field downstream from both the first and second baffles 40, 45. As the liquid moves through the flow-through channel 25, the gas is introduced into the first local constriction 85 via the port 97, thereby mixing the gas with the liquid as the liquid passes through the first local constriction 85. The gas can be introduced into the liquid in the first local constriction 85 and maintained at a flow rate that is different from the liquid flow rate and sufficient to control the collapse of cavitation bubbles formed in the hydrodynamic cavitation field. For example, a ratio between the gas volumetric flow rate and the liquid volumetric flow rate is about 0.1 or less. In other words, the ratio between the liquid volumetric flow rate and the gas volumetric flow rate can be at least about 10.

While passing through the first local constriction 85, the velocity of the liquid increases to the minimum cavitation velocity for the particular fluid being processed. The increased velocity of the liquid forms the first hydrodynamic cavitation field 80 downstream from the first baffle 40, thereby generating cavitation bubbles that grow when mixed with the gas to form gas micro bubbles. Upon reaching an elevated static pressure zone, the gas micro bubbles can be partially or completely collapsed (or squeezed) thereby dissolving the gas into the liquid to form a gas-saturated liquid.

Once the gas micro bubbles are generated after the first stage of hydrodynamic cavitation, the gas-saturated liquid continues to move towards the second baffle 45. While passing through the second local constriction 95, the velocity of the gas-saturated liquid increases to a minimum cavitation velocity of the liquid. The increased velocity of the gas-saturated liquid, forms the second hydrodynamic cavitation field 90 downstream from the second baffle 45 thereby generating cavitation bubbles. Upon reaching an elevated static pressure zone, a vacuum is created in the second hydrodynamic cavitation field 90 to extract the dissolved gas from the gas-saturated liquid, thereby generating micro bubbles. These micro bubbles are smaller in size and more uniform than the micro bubbles produced after the first stage of hydrodynamic cavitation. The liquid and micro bubbles then exits the flow-through channel 25 via the outlet 35.

Figure 2:
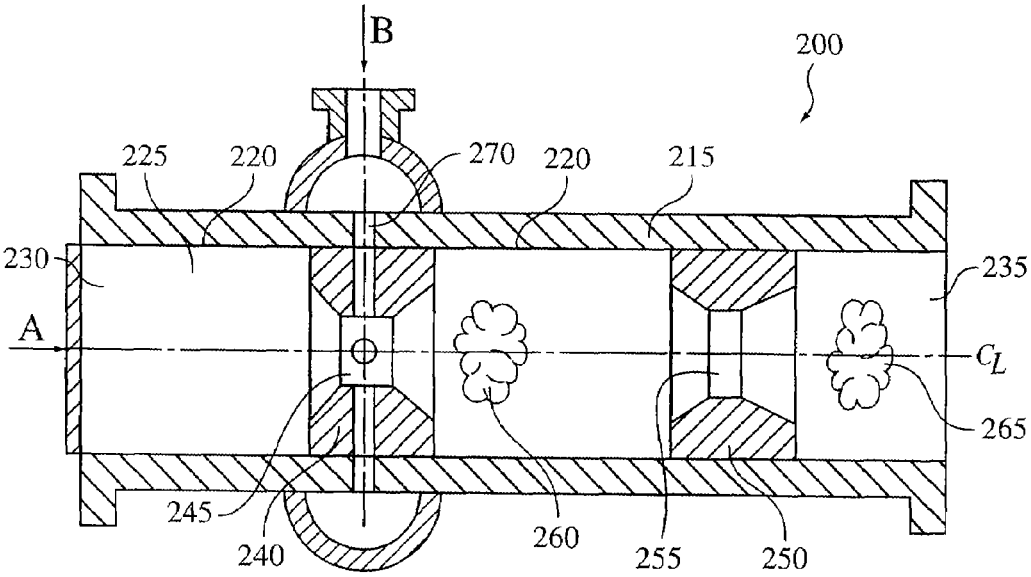
FIG. 2 is a longitudinal cross-section of another embodiment of a hydrodynamic cavitation device 200 for generating micro bubbles in a liquid.

Illustrated in FIG. 2 is a longitudinal cross-section of another embodiment of a hydrodynamic cavitation device 200 for generating micro bubbles in a liquid. The device 200 includes a wall 215 having an inner surface 220 that defines a flow-through channel or chamber 225 having a centerline $C_L$. For example, the wall 215 can be a cylindrical wall that defines a flow-through channel having a circular cross-section. It will be appreciated that the cross-section of flow-through channel 225 may take the form of other geometric shapes such as square, rectangular, hexagonal, or any other complex shape. The flow-through channel 225 can further include an inlet 230 configured to introduce a liquid into the device 200 along a path represented by arrow A and an outlet 235 configured to exit the liquid from the device 200.

With further reference to FIG. 2, in one embodiment, the device 200 can further include multiple cavitation generators that generate a cavitation field downstream from each cavitation generator. For example, the device 200 can include two stages of hydrodynamic cavitation where a first cavitation generator can be a first plate 240 having an orifice 245 disposed therein to produce a first local constriction of liquid flow and a second cavitation generator can be a second plate 250 having an orifice 255 disposed therein to produce a second local constriction of liquid flow. It will be appreciated that any number of stages of hydrodynamic cavitation can be provided within the flow-through channel 225. Furthermore, it will be appreciated that other types of cavitation generators may be used instead of plates having orifices disposed therein such as baffles. As discussed above, the size of the local constrictions of flow are sufficient to increase the velocity of the liquid flow to the minimum cavitation velocity for the fluid being processed.

Each plate 240, 250 can be mounted to the wall 215 with screws or any other attachment means to retain each plate 240, 250 in the flow-through channel 225. In another embodiment, the first and second plates 240, 250 can include multiple orifices disposed therein to produce multiple local constrictions of fluid flow. It will be appreciated that each plate can be embodied as a disk when the flow-through channel 225 has a circular cross-section, or each plate can be embodied in a variety of shapes and configurations that can match the cross-section of the flow-through channel 225.

In one embodiment, the second plate 250 is positioned within the flow-through channel downstream from the first plate 240. For example, the first and second plates 240, 250 can be positioned substantially along the centerline $C_L$ of the flow-through channel 225 such that the orifice 245 in the first plate 240 is substantially coaxial with the orifice in the second plate 250.

To vary the degree and character of the cavitation fields generated downstream from the first and second plates 240, 250, the orifices 245, 255 can be embodied in a variety of different shapes and configurations. The shape and configuration of each orifice 245, 255 can significantly affect the character of the cavitation flow and, correspondingly, the quality of crystallization. In one embodiment, the orifices 245, 255 can have a circular cross-section. It will be appreciated that each orifice 245, 255 can be configured in the shape of a Venturi tube, nozzle, orifice of any desired shape, or slot. Further, it will be appreciated that the orifices 245, 255 can be embodied in other shapes and configurations such as the ones disclosed in U.S. Pat. No. 5,969,207, which is hereby incorporated by reference in its entirety herein. Of course, it will be appreciated that the orifice 245 disposed in the first plate 240 can be embodied in one shape and configuration, while the orifice 255 disposed in the second plate 250 can be embodied in a different shape and configuration.

In one embodiment, the orifice 245 disposed in the first plate 240 can be configured to generate a first hydrodynamic cavitation field 260 downstream from the orifice 245. Likewise, the orifice 255 disposed in the second plate 250 can be configured to generate a second hydrodynamic cavitation field 265 downstream from the orifice 255.

With further reference to FIG. 2, the flow-through channel 225 can further include a port 270 for introducing a gas into the flow-through channel 225 along a path represented by arrow B. For example, the gas can be air, oxygen, nitrogen, hydrogen, ozone, or steam. In one embodiment, the port 270 can be disposed in the wall 215 and extended through the plate 240 to permit the introduction of the gas into the liquid in the first local constriction of flow. For example, the gas can be introduced into the liquid in a region of reduced liquid pressure in the first local constriction of flow. It will be appreciated that the port 270 can be disposed in the wall 215 anywhere along the axial length of the orifice 245 disposed in the first plate 240. Furthermore, it will be appreciated that any number of ports can be provided in the wall 215 to introduce gas into the orifice 245 disposed in the first plate 240 or the port 270 can be embodied as a slot to introduce gas into the orifice 245 disposed in the first plate 240.

In operation of the device 200 illustrated in FIG. 2, the liquid is fed into the flow-through channel 225 via the inlet 230 along the path A. The liquid can be fed through the flow-through channel 225 and maintained at any flow rate sufficient to generate a hydrodynamic cavitation field downstream from both the first and second plates 240, 250. As the liquid moves through the flow-through channel 225, the gas is introduced into the orifice 245 disposed in the first plate 240 via the port 270 thereby mixing the gas with the liquid as the liquid passes through the orifice 245 disposed in the first plate 240. The gas can be introduced into the liquid in the orifice 245 disposed in the first plate 240 and maintained at a flow rate that is different from the liquid flow rate and sufficient to control the collapse of cavitation bubbles formed in the hydrodynamic cavitation field. For example, a ratio between the volumetric gas flow rate and the volumetric liquid flow rate is about 0.1 or less. In other words, the ratio between the volumetric liquid flow rate and the volumetric gas flow rate can be at least about 10.

While passing through the orifice 245 disposed in the first plate 240, the velocity of the liquid increases to a minimum cavitation velocity for the particular liquid being processed. The increased velocity of the liquid forms the first hydrodynamic cavitation field 260 downstream from the first plate 240, thereby generating cavitation bubbles that grow when mixed with the gas to form gas micro bubbles. Upon reaching an elevated static pressure zone, the gas micro bubbles can be partially or completely collapsed (or squeezed), thereby dissolving the gas into the liquid to form a gas-structured liquid.

Once the gas micro bubbles are generated after the first stage of hydrodynamic cavitation, the gas-saturated liquid continue to move towards the second plate 250. While passing through the orifice 255 disposed in the second plate 250, the velocity of the gas-saturated liquid increases to the minimum cavitation velocity of the liquid. The increased velocity of the gas-saturated liquid forms the second hydrodynamic cavitation field 265 downstream from the second plate 250, thereby generating cavitation bubbles. Upon reaching an elevated static pressure zone, a vacuum is created in the second hydrodynamic cavitation field 265 to extract the dissolved gas from the gas-saturated liquid thereby generating micro bubbles. These micro bubbles are smaller in size and more uniform than the micro bubbles produced after the first stage of hydrodynamic cavitation. The liquid and micro bubbles then exits the flow-through channel 225 via the outlet 235.

Figure 3:
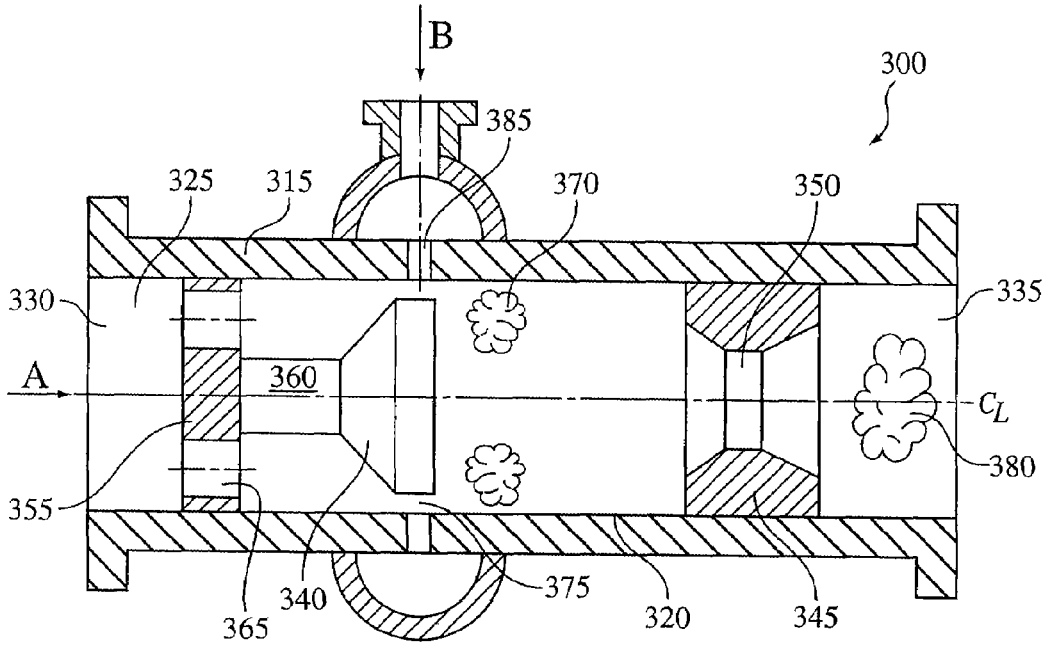
FIG. 3 is a longitudinal cross-section of another embodiment of a hydrodynamic cavitation device 300 for generating micro bubbles in a liquid.

Illustrated in FIG. 3 is a longitudinal cross-section of another embodiment of a hydrodynamic cavitation device 300 for generating micro bubbles in a liquid. The device 300 includes a wall 315 having an inner surface 320 that defines a flow-through channel or chamber 325 having a centerline $C_L$. The flow-through channel 325 can further include an inlet 330 configured to introduce a liquid into the device 300 along a path represented by arrow A and an outlet 335 configured to exit the liquid from the device 300.

With further reference to FIG. 3, in one embodiment, the device 300 can further include multiple cavitation generators that generate a cavitation field downstream from each cavitation generator. For example, the device 300 can include two stages of hydrodynamic cavitation where a first cavitation generator can be a baffle 340 and a second cavitation generator can be a plate 345 having an orifice 350 disposed therein to produce a local constriction of liquid flow. It will be appreciated that the plate 355 can be embodied as a disk when the flow-through channel 325 has a circular cross-section, or the plate 355 can be embodied in a variety of shapes and configurations that can match the cross-section of the flow-through channel 325. Further, it will be appreciated that any number of stages of hydrodynamic cavitation can be provided within the flow-through channel 325. As discussed above, the size of the local constrictions of flow are sufficient to increase the velocity of the fluid flow to a minimum cavitation velocity for the fluid being processed.

In one embodiment, the plate 345 is positioned within the flow-through channel downstream from the baffle 340. For example, the baffle 340 and the plate 345 can be positioned substantially along the centerline $C_L$ of the flow-through channel 325 such that the baffle 340 is substantially coaxial with the orifice 350 disposed in the plate 345.

To retain the baffle 340 within the flow-through channel 325, the baffle 340 can be connected to a plate 355 via a stem or shaft 360. It will be appreciated that the plate 355 can be embodied as a disk when the flow-through channel 325 has a circular cross-section, or the plate 355 can be embodied in a variety of shapes and configurations that can match the cross-section of the flow-through channel 325. The plate 355 can be mounted to the inside surface 320 of the wall 315 with screws or any other attachment means. The plate 355 can include a plurality of orifices 365 configured to permit liquid to pass therethrough. To retain the plate 345 within the flow-through channel 325, the plate 345 can be connected to the wall 315 with screws or any other attachment means.

In one embodiment, the baffle 340 can be configured to generate a first hydrodynamic cavitation field 370 downstream from the baffle 340 via a first local constriction 375 of liquid flow. For example, the first local constriction 375 of liquid flow can be an area defined between the inner surface 320 of the wall 315 and an outside surface of the baffle 340. Also, the orifice 350 disposed in the plate 345 can be configured to generate a second hydrodynamic cavitation field 380 downstream from the orifice 350.

With further reference to FIG. 3, the flow-through channel 325 can further include a port 385 for introducing a gas into the flow-through channel 325 along a path represented by arrow B. In one embodiment, the port 385 can be disposed in the wall 315 and positioned adjacent the first local constriction 375 of flow to permit the introduction of the gas into the liquid in the first local constriction 375 of flow. For example, the gas can be introduced into the liquid in a region of reduced liquid pressure in the first local constriction of flow. It will be appreciated that the port 385 can be disposed in the wall 315 anywhere along the axial length first local constriction 375 of flow. Furthermore, it will be appreciated that any number of ports can be provided in the wall 315 to introduce the gas into the first local constriction 375 or the port 385 can be embodied as a slot to introduce the gas into the first local constriction 375.

In operation of the device 300 illustrated in FIG. 3, the liquid enters the flow-through channel 325 via the inlet 330 and moves through the orifices 365 in the plate 360 along the path A. The liquid can be fed through the flow-through channel 325 and maintained at any flow rate sufficient to generate a hydrodynamic cavitation field downstream from both the first and second cavitation generators. As the liquid moves through the flow-through channel 325, the gas is introduced into the first local constriction 375 via the port 385 thereby mixing the gas with the liquid as the liquid passes through the first local constriction 375. The gas can be introduced into the liquid in the first local constriction 375 and maintained at a flow rate that is different from the liquid flow rate and sufficient to control the collapse of cavitation bubbles formed in the hydrodynamic cavitation field. For example, a ratio between the gas volumetric flow rate and the liquid volumetric flow rate is about 0.1 or less. In other words, the ratio between the liquid volumetric flow rate and the gas volumetric flow rate can be at least about 10.

While passing through the first local constriction 375, the velocity of the liquid increases to a minimum cavitation velocity for the particular liquid being processed. The increased velocity of the liquid forms the first hydrodynamic cavitation field 370 downstream from the baffle 340, thereby generating cavitation bubbles that grow when mixed with the gas to form gas micro bubbles. Upon reaching an elevated static pressure zone, the gas micro bubbles can be partially or completely collapsed (or squeezed), thereby dissolving the gas into the liquid to form a gas-saturated liquid.

Once the gas micro bubbles are generated after the first stage of hydrodynamic cavitation, the gas-saturated liquid continues to move towards the plate 350. While passing through the orifice 350 disposed in the plate 345, the velocity of the gas-saturated liquid increases to the minimum cavitation velocity of the liquid. The increased velocity of the gas-saturated liquid forms the second hydrodynamic cavitation field 380 downstream from the plate 345, thereby generating cavitation bubbles. Upon reaching an elevated static pressure zone, a vacuum is created in the second hydrodynamic cavitation field 380 to extract the dissolved gas from the gas-saturated liquid, thereby generating micro bubbles. The micro bubbles are smaller in size and more uniform than the micro bubbles produced after the first stage of hydrodynamic cavitation. The liquid and micro bubbles then exit the flow-through channel 325 via the outlet 335.

Figure 4:
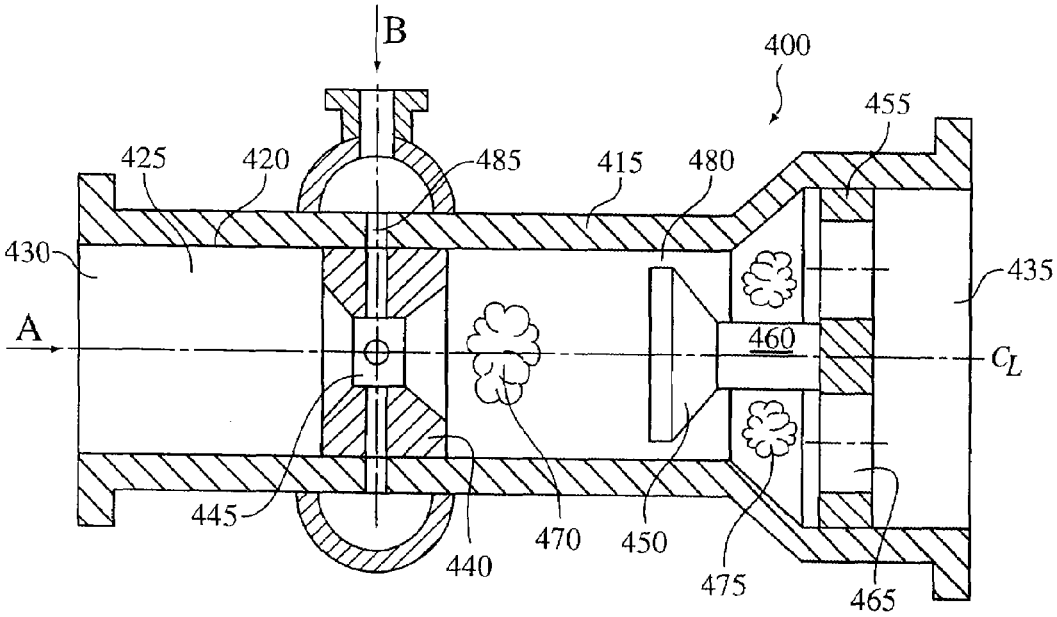
FIG. 4 is a longitudinal cross-section of another embodiment of a hydrodynamic cavitation device 400 for generating micro bubbles in a liquid.

Illustrated in FIG. 4 is a longitudinal cross-section of another embodiment of a hydrodynamic cavitation device 400 for generating micro bubbles in a liquid. The device 400 includes a wall 415 having an inner surface 420 that defines a flow-through channel or chamber 425 having a centerline $C_L$. The flow-through channel 425 can further include an inlet 430 configured to introduce a liquid into the device 400 along a path represented by arrow A and an outlet 435 configured to exit the liquid from the device 400.

With further reference to FIG. 4, in one embodiment, the device 400 can further include multiple cavitation generators that generate a cavitation field downstream from each cavitation generator. For example, the device 400 can include two stages of hydrodynamic cavitation where a first cavitation generator can be a plate 440 having an orifice 445 disposed therein to produce a local constriction of liquid flow and a second cavitation generator can be a baffle 450. It will be appreciated that the plate 455 can be embodied as a disk when the flow-through channel 325 has a circular cross-section, or the plate 455 can be embodied in a variety of shapes and configurations that can match the cross-section of the flow-through channel 325. Further, it will be appreciated that any number of stages of hydrodynamic cavitation can be provided within the flow-through channel 425. As discussed above, the size of the local constrictions of flow are sufficient to increase the velocity of the fluid flow to a minimum cavitation velocity for the fluid being processed.

In one embodiment, the plate 440 is positioned within the flow-through channel upstream from the baffle 450. For example, the plate 440 and the baffle 450 can be positioned substantially along the centerline $C_L$ of the flow-through channel 425 such that the baffle 450 is substantially coaxial with the orifice 445 disposed in the plate 440.

To retain the plate 440 within the flow-through channel 425, the plate 440 can be connected to the wall 415 with screws or any other attachment means. To retain the baffle 450 within the flow-through channel 425, the baffle 450 can be connected to a plate 455 via a stem or shaft 460. It will be appreciated that the plate 455 can be embodied as a disk when the flow-through channel 425 has a circular cross-section, or the plate 455 can be embodied in a variety of shapes and configurations that can match the cross-section of the flow-through channel 425. The plate 455 can be mounted to the inside surface 420 of the wall 415 with screws or any other attachment means. The plate 455 can include a plurality of orifices 465 configured to permit liquid to pass therethrough.

In one embodiment, the orifice 445 disposed in the plate 450 can be configured to generate a first hydrodynamic cavitation field 470 downstream from the orifice 245. Also, the baffle 450 can be configured to generate a second hydrodynamic cavitation field 475 downstream from the baffle 450 via a local constriction 480 of liquid flow. For example, the local constriction 475 of liquid flow can be an area defined between the inner surface 420 of the wall 415 and an outside surface of the baffle 450.

With further reference to FIG. 4, the flow-through channel 425 can further include a port 485 for introducing a gas into the flow-through channel 425 along a path represented by arrow B. In one embodiment, the port 485 can be disposed in the wall 415 and extended through the plate 440 to permit the introduction of the gas into the liquid in the local constriction 480 of flow. For example, the gas can be introduced into the liquid in a region of reduced liquid pressure in the first local constriction 480 of flow. It will be appreciated that the port 485 can be disposed in the wall 415 anywhere along the axial length of the orifice 445 disposed in the plate 440. Furthermore, it will be appreciated that any number of ports can be provided in the wall 415 to introduce gas into the orifice 445 disposed in the plate 440 or the port 485 can be embodied as a slot to introduce gas into the orifice 445 disposed in the plate 440.

In operation of the device 400 illustrated in FIG. 4, the liquid is fed into the flow-through channel 425 via the inlet 430 along the path A. The liquid can be fed through the flow-through channel 425 and maintained at any flow rate sufficient to generate a hydrodynamic cavitation field downstream from both the first and second cavitation generators. As the liquid moves through the flow-through channel 425, the gas is introduced into the orifice 445 disposed in the plate 440 via the port 485 thereby mixing the gas with the liquid as the liquid passes through the orifice 445. The gas can be introduced into the liquid in the orifice 445 disposed in the plate 440 and maintained at a flow rate that is different from the liquid flow rate and sufficient to control the collapse of cavitation bubbles formed in the hydrodynamic cavitation field. For example, a ratio between the gas volumetric flow rate and the liquid volumetric flow rate is about 0.1 or less. In other words, the ratio between the liquid volumetric flow rate and the gas volumetric flow rate can be at least about 10.

While passing through the orifice 445 disposed in the plate 440, the velocity of the liquid increases to a minimum cavitation velocity for the particular liquid being processed. The increased velocity of the liquid forms the first hydrodynamic cavitation field 470 downstream from the plate 440, thereby generating cavitation bubbles that grow when mixed with the gas to form gas micro bubbles. Upon reaching an elevated static pressure zone, the gas micro bubbles can be partially or completely collapsed (or squeezed), thereby dissolving the gas into the liquid to form a gas-saturated liquid.

Once the gas micro bubbles are generated after the first stage of hydrodynamic cavitation, the gas-saturated liquid continues to move towards the baffle 450. While passing through the local constriction 480 of flow, the velocity of the gas-saturated liquid increases to the minimum cavitation velocity of the liquid. The increased velocity of the gas-saturated liquid forms the second hydrodynamic cavitation field 475 downstream from the baffle 450, thereby generating cavitation bubbles. Upon reaching an elevated static pressure zone, a vacuum is created in the second hydrodynamic cavitation field 475 to extract the dissolved gas from the gas-saturated liquid thereby generating micro bubbles. These micro bubbles are smaller in size and more uniform than the micro bubbles produced after the first stage of hydrodynamic cavitation. The liquid and micro bubbles then exit the flow-through channel 425 via the outlet 435.

Figure 5:
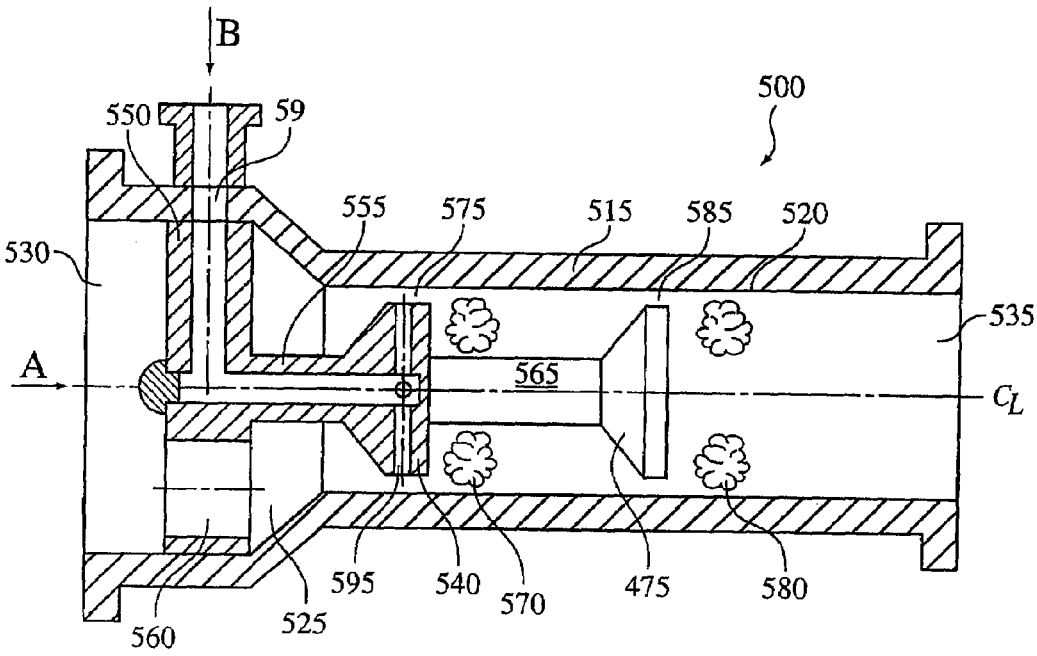
FIG. 5 is a longitudinal cross-section of another embodiment of a hydrodynamic cavitation device 500 for generating micro bubbles in a liquid.

Illustrated in FIG. 5 is a longitudinal cross-section of another embodiment of a hydrodynamic cavitation device 500 for generating micro bubbles in a liquid. The device 500 includes a wall 515 having an inner surface 520 that defines a flow-through channel or chamber 525 having a centerline $C_L$. The flow-through channel 525 can further include an inlet 530 configured to introduce a liquid into the device 500 along a path represented by arrow A and an outlet 535 configured to exit the liquid from the device 500.

With further reference to FIG. 5, in one embodiment, the device 500 can further include multiple cavitation generators that generate a cavitation field downstream from each cavitation generator. For example, the device 500 can include two stages of hydrodynamic cavitation where a first cavitation generator can be a first baffle 540 and a second cavitation generator can be a second baffle 345. It will be appreciated that any number of stages of hydrodynamic cavitation can be provided within the flow-through channel 525.

In one embodiment, the first baffle 545 is positioned within the flow-through channel 525 downstream from the first baffle 540. For example, the first and second baffles 540, 545 can be positioned substantially along the centerline $C_L$ of the flow-through channel 525 such that the first baffle 540 is substantially coaxial with the second baffle 545.

To vary the degree and character of the cavitation fields generated downstream from the first and second baffles 540, 545, the first and second baffles 540, 545 can be embodied in a variety of different shapes and configurations. It will be appreciated that the first and second baffles 540, 545 can be embodied in other shapes and configurations such as the ones disclosed in U.S. Pat. No. 5,969,207, issued on Oct. 19, 1999, which is hereby incorporated by reference in its entirety herein. Of course, it will be appreciated that the first baffle 540 can be embodied in one shape and configuration, while the second baffle 545 can be embodied in a different shape and configuration.

To retain the first baffle 540 within the flow-through channel 525, the first baffle 540 can be connected to a plate 550 via a stem or shaft 555. The plate 550 can be mounted to the inside surface 520 of the wall 515 with screws or any other attachment means. The plate 550 can include at least one orifice 560 configured to permit liquid to pass therethrough. To retain the second baffle 545 within the flow-through channel 525, the second baffle 545 can be connected to the first baffle 540 via a stem or shaft 565 or any other attachment means.

In one embodiment, the first baffle 540 can be configured to generate a first hydrodynamic cavitation field 570 downstream from the first baffle 540 via a first local constriction 575 of liquid flow. For example, the first local constriction 575 of liquid flow can be an area defined between the inner surface 520 of the wall 515 and an outside surface of the first baffle 540. Also, the second baffle 545 can be configured to generate a second hydrodynamic cavitation field 580 downstream from the second baffle 545 via a second local constriction 585 of liquid flow. For example, the second local constriction 585 can be an area defined between the inner surface 520 of the wall 515 and an outside surface of the second baffle 545. As discussed above, the size of the local constrictions 575, 585 of flow are sufficient to increase the velocity of the fluid flow to a minimum cavitation velocity for the fluid being processed.

With further reference to FIG. 5, the flow-through channel 525 can further include a fluid passage 590 for introducing a gas into the flow-through channel 525 along a path represented by arrow B. In one embodiment, the port 590 can be disposed in the wall 515 to permit the introduction of the gas into the liquid in the first local constriction 575 of flow. For example, the gas can be introduced into the liquid in a region of reduced liquid pressure in the first local constriction 575 of flow. Beginning at the wall 515, the fluid passage 590 extends through the plate 550, the stem 555, and at least partially into the first baffle 540. It will be appreciated that the fluid passage 595 can be embodied in any shape or path. In the first baffle 540, the fluid passage terminates into at least one port 595 that extends radially from the $C_L$ of the first baffle 540 and exits in the first local constriction 575 of flow. Furthermore, it will be appreciated that the port 595 can be disposed in the first baffle 540 anywhere along the axial length of the first local constriction 575 of flow. Furthermore, it will be appreciated that any number of ports can be provided in the first baffle to introduce gas into the first local constriction 575 of flow or the port 595 can be embodied as a slot to introduce gas into the first local constriction 575 of flow.

In operation of the device 500 illustrated in FIG. 5, the liquid enters the flow-through channel 525 via the inlet 530 and moves through the at least one orifice 560 in the plate 550 along the path A. The liquid can be fed through the flow-through channel 525 and maintained at any flow rate sufficient to generate a hydrodynamic cavitation field downstream from both the first and second baffles 540, 545. As the liquid moves through the flow-through channel 525, the gas is introduced into the first local constriction 575 via the port 590 and the passage 595 thereby mixing the gas with the liquid as the liquid passes through the first local constriction 575. The gas can be introduced into the liquid in the first local constriction 575 and maintained at a flow rate that is different from the liquid flow rate and sufficient to control the collapse of cavitation bubbles formed in the hydrodynamic cavitation field. For example, a ratio between the gas volumetric flow rate and the liquid volumetric flow rate is about 0.1 or less. In other words, the ratio between the liquid volumetric flow rate and the gas volumetric flow rate can be at least about 10.

While passing through the first local constriction 575, the velocity of the liquid increases to a minimum cavitation velocity for the particular liquid being processed. The increased velocity of the liquid forms the first hydrodynamic cavitation field 580 downstream from the first baffle 540, thereby generating cavitation bubbles that grow when mixed with the gas to form gas micro bubbles. Upon reaching an elevated static pressure zone, the bubbles can be partially or completely collapsed (or squeezed), thereby dissolving the gas into the liquid to form a gas-saturated liquid.

Once the gas micro bubbles are generated after the first stage of hydrodynamic cavitation, the gas-saturated liquid continues to move towards the second baffle 545. While passing through the second local constriction 585, the velocity of the gas-saturated liquid increases to the minimum cavitation velocity of the liquid. The increased velocity of the gas-saturated liquid forms the second hydrodynamic cavitation field 580 downstream from the second baffle 545, thereby generating cavitation bubbles. Upon reaching an elevated static pressure zone, a vacuum is created in the second hydrodynamic cavitation field 580 to extract the dissolved gas from the gas-saturated liquid, thereby generating micro bubbles. The micro bubbles are smaller in size and more uniform than the micro bubbles produced after the first stage of hydrodynamic cavitation. The liquid and micro bubbles then exit the flow-through channel 525 via the outlet 535.

The following examples are given for the purpose of illustrating the present invention and should not be construed as limitations on the scope or spirit of the instant invention.

EXAMPLE 1

The following example of a method of generating micro bubbles in liquid was carried out in a device substantially similar to the device 200 as shown in FIG. 2, except that the device included only one stage of hydrodynamic cavitation. Water was fed, via a high pressure pump, through the flow-through channel 225, at a velocity of 30.12 meters per second (m/sec) and a flow rate of 5.68 liter per minute (l/min). Air was introduced, via a compressor, into the flow-through channel 225 via the port 270 in the first local constriction of flow 245 at a flow rate of 0.094 standard liters per minute (sl/min). Accordingly, the volume ratio of the air flow rate to the water flow rate was 0.017. The combined water and air then passed through the local constriction of flow 245 creating hydrodynamic cavitation to thereby effectuate the generation of micro bubbles. The resultant bubble size of the micro bubbles was between 5,000 and 7,000 microns.

EXAMPLE 2

The following example of a method of generating micro bubbles in liquid was carried out in a device substantially similar to the device 200 as shown in FIG. 2, which included two stages of hydrodynamic cavitation. Water was fed, via a high pressure pump, through the flow-through channel 225, at a velocity of 30.12 m/sec and a flow rate of 5.68 l/min. Air was introduced, via a compressor, into the flow-through channel 225 via the port 270 in the first local constriction of flow 245 at a flow rate of 0.566 sl/min. Accordingly, the volume ratio of the air flow rate to the water flow rate was 0.100. The combined water and air then passed through the first and second local constrictions of flow 245, 255 creating hydrodynamic cavitation to thereby effectuate the generation of micro bubbles. The resultant bubble size of the micro bubbles was between 200 and 300 microns.

The method above was repeated in the device 200, except that the gas flow rate was changed. The results are illustrated in Chart 1 below.

CHART 1

| Test | Liquid Flow Rate (l/min) | Gas Flow Rate (sl/min) | Volume ratio - gas flow rate to liquid flow rate | Bubble size (microns) |
|---|---|---|---|---|
| 1 | 5.68 | 0.472 | 0.080 | 100-200 |
| 2 | 5.68 | 0.080 | 0.014 | 100-200 |
| 3 | 5.68 | 0.047 | 0.008 | 100-200 |
| 4 | 5.68 | 0.033 | 0.006 | 100-200 |

EXAMPLE 3

The following example of a method of generating micro bubbles in liquid was carried out in a device substantially similar to the device 200 as shown in FIG. 2, except that the device included only one stage of hydrodynamic cavitation. Water was fed, via a high pressure pump, through the flow-through channel 225, at a velocity of 46.21 m/sec and a flow rate of 8.71 l/min. Air was introduced, via a compressor, into the flow-through channel 225 via the port 270 in the first local constriction of flow 245 at a flow rate of 0.212 standard sl/min. Accordingly, the volume ratio of the air flow rate to the water flow rate was 0.024. The combined water and air then passed through the local constriction of flow 245 creating hydrodynamic cavitation to thereby effectuate the generation of micro bubbles. The resultant bubble size of the micro bubbles was between 5,000 and 7,000 microns.

EXAMPLE 4

The following example of a method of generating micro bubbles in liquid was carried out in a device substantially similar to the device 200 as shown in FIG. 2, which included two stages of hydrodynamic cavitation. Water was fed, via a high pressure pump, through the flow-through channel 225, at a velocity of 46.21 m/sec and a flow rate of 8.71 l/min. Air was introduced, via a compressor, into the flow-through channel 225 via the port 270 in the first local constriction of flow 245 at a flow rate of 0.614 sl/min. Accordingly, the volume ratio of the air flow rate to the water flow rate is 0.070. The combined water and air then passed through the first and second local constrictions of flow 245, 255 creating hydrodynamic cavitation to thereby effectuate the generation of micro bubbles. The resultant bubble size of the micro bubbles was between 200 and 300 microns.

The method above was repeated in the device 200, except that the gas flow rate was changed. The results are illustrated in Chart 2 below.

CHART 2

| Test | Liquid Flow Rate (l/min) | Gas Flow Rate (sl/min) | Volume ratio - gas flow rate to liquid flow rate | Bubble size (microns) |
|---|---|---|---|---|
| 1 | 8.71 | 0.472 | 0.054 | 100-200 |
| 2 | 8.71 | 0.234 | 0.027 | 100-200 |
| 3 | 8.71 | 0.080 | 0.009 | 100-200 |
| 4 | 8.71 | 0.047 | 0.005 | 100-200 |
| 5 | 8.71 | 0.033 | 0.004 | 100-200 |

EXAMPLE 5

The following example of a method of generating micro bubbles in liquid was carried out in a device substantially similar to the device 200 as shown in FIG. 2, except that the device included only one stage of hydrodynamic cavitation. Water was fed, via a high pressure pump, through the flow-through channel 225, at a velocity of 60.48 m/sec and a flow rate of 11.4 l/min. Air was introduced, via a compressor, into the flow-through channel 225 via the port 270 in the first local constriction of flow 245 at a flow rate of 0.236 sl/min. Accordingly, the volume ratio of the air flow rate to the water flow rate is 0.021. The combined water and air then passed through the local constriction of flow 245 creating hydrodynamic cavitation to thereby effectuate the generation of micro bubbles. The resultant bubble size of the micro bubbles was between 5,000 and 8,000 microns.

EXAMPLE 6

The following example of a method of generating micro bubbles in liquid was carried out in a device substantially similar to the device 200 as shown in FIG. 2, which included two stages of hydrodynamic cavitation. Water was fed, via a high pressure pump, through the flow-through channel 225, at a velocity of 60.48 m/sec and a flow rate of 11.4 l/min. Air was introduced, via a compressor, into the flow-through channel 225 via the port 270 in the first local constriction of flow 245 at a flow rate of 0.991 sl/min. Accordingly, the volume ratio of the air flow rate to the water flow rate is 0.087. The combined water and air then passed through the first and second local constrictions of flow 245, 255 creating hydrodynamic cavitation to thereby effectuate the generation of micro bubbles. The resultant bubble size of the micro bubbles was between 200 and 300 microns.

The method above was repeated in the device 200, except that the gas flow rate was changed. The results are illustrated in Chart 3 below.

CHART 3

| Test | Liquid Flow Rate (l/min) | Gas Flow Rate (sl/min) | Volume ratio - gas flow rate to liquid flow rate | Bubble size (microns) |
|---|---|---|---|---|
| 1 | 11.4 | 0.520 | 0.046 | 100-200 |
| 2 | 11.4 | 0.378 | 0.033 | 100-200 |
| 3 | 11.4 | 0.189 | 0.017 | 100-200 |
| 4 | 11.4 | 0.094 | 0.008 | 100-200 |
| 5 | 11.4 | 0.057 | 0.005 | 100-200 |
| 6 | 11.4 | 0.024 | 0.002 | 100-200 |

Although the invention has been described with reference to the preferred embodiments, it will be apparent to one skilled in the art that variations and modifications are contemplated within the spirit and scope of the invention. The drawings and description of the preferred embodiments are made by way of example rather than to limit the scope of the invention, and it is intended to cover within the spirit and scope of the invention all such changes and modifications.

What is claimed is:

1. A method of generating micro bubbles in a liquid comprising the steps of:

providing a flow-through channel containing at least two local constrictions of flow therein, the at least two local constrictions include a first and second local constrictions of flow;

passing the liquid at a velocity of at least at least 12 m/sec through the first local constriction of flow to create a first hydrodynamic cavitation field downstream from the first local constriction of flow;

introducing a gas into the liquid in the first local constriction of flow, thereby creating gas-filled cavitation bubbles;

collapsing the gas-filled cavitation bubbles formed in the first hydrodynamic cavitation field to dissolve the gas into the liquid, thereby forming a gas-saturated liquid;

passing the gas-saturated liquid through the second local constriction of flow to create a second hydrodynamic cavitation field downstream from the second local constriction of flow; and extracting the dissolved gas from the gas-saturated liquid, thereby generating micro bubbles in the liquid.

2. The method of claim 1, wherein the first collapsing step occurs upon reaching an elevated static pressure zone created by the second local constriction of flow.

3. The method of claim 1, wherein the extracting step occurs upon reaching a vacuum zone created in the second hydrodynamic cavitation field.

4. The method of claim 1, wherein the gas is introduced into the liquid in a region of reduced liquid pressure in the first local constriction of flow.

5. The method of claim 1, wherein the gas is introduced at a gas flow rate sufficient to control the collapse of the cavitation bubbles formed in the first hydrodynamic cavitation field.

6. The method of claim 5, wherein a ratio of the liquid flow rate to the gas flow rate is at least about 10.

7. The method of claim 1, wherein the gas micro bubbles generated downstream from the second local constriction of flow are one or both of, smaller in size, and more uniform, than the cavitation bubbles formed in the first hydrodynamic cavitation field.

8. The method of claim 1, wherein the cross-sectional area of one or both of, the first local constriction of flow and the second local constriction of flow, is less than about 0.6 times the major diameter of the cross-section of the flow-through channel.

9. A method of generating micro bubbles in a liquid, comprising the steps of:

feeding the liquid into a flow-through channel at a first flow-rate, the flow-through channel including at least two cavitation generators, where a first cavitation generator is located upstream of a second cavitation generator;

introducing a gas into the first cavitation generator at a second flow rate;

flowing the liquid and the gas into the first cavitation generator at a velocity of at least 12 m/sec, thereby generating cavitation bubbles in the liquid in a first hydrodynamic cavitation field located downstream from the first cavitation generator;

at least partially squeezing the cavitation bubbles in an elevated static pressure zone, thereby dissolving the gas into the liquid; and flowing the liquid containing the dissolved gas into the second cavitation generator at the minimum velocity, thereby extracting the dissolved gas from the liquid and generating micro bubbles in a second hydrodynamic cavitation field located downstream from the second cavitation generator;

wherein the micro bubbles are one or both of, smaller in size, and more uniform, than the cavitation bubbles.

10. The method of claim 9, wherein at least one of the cavitation generators includes a baffle.

11. The method of claim 9, wherein a ratio of the liquid volumetric flow rate to the gas volumetric flow rate is at least about 10.

12. The method of claim 9, wherein at least partially squeezing the cavitation bubbles in an elevated static pressure zone occurs downstream of the first cavitation generator and upstream of the second cavitation generator.

13. The method of claim 9, wherein the cavitation generators each include a local constriction of flow.

14. The method of claim 13, wherein the local constriction of flow includes one or more of, a baffle, an orifice, a nozzle, and a Venturi tube.

15. The method of claim 13, wherein the cross-sectional area of at least one of the local constrictions of flow is less than about 0.6 times the major diameter of the cross-section of the flow-through channel.

16. A method of generating micro bubbles in a liquid comprising the steps of:

feeding the liquid through a flow-through channel internally containing at least two local constrictions of flow, the at least two local constrictions of flow including a first local constriction of flow and a second local constriction of flow positioned downstream from the first local constriction of flow;

passing the liquid at a velocity of at least 12 m/sec through the first local constriction of flow to create a first hydrodynamic cavitation field downstream from the first local constriction of flow;

creating cavitation bubbles in the first hydrodynamic cavitation field;

introducing gas into the flow-through chamber in the upstream local constriction of flow;

upon reaching an elevated static pressure zone created by the second local constriction of flow, collapsing the cavitation bubbles created in the first hydrodynamic cavitation field to dissolve the gas into the liquid, thereby forming a gas-saturated liquid;

maintaining a ratio of the liquid volumetric flow rate to the gas volumetric flow rate at a minimum ratio of at least about 10 to, at least in part, control the collapse of the cavitation bubbles;

passing the gas-saturated liquid flow at a velocity of at least 16 m/sec through the second local constriction of flow to create a second hydrodynamic cavitation field downstream from the second local constriction of flow; and upon reaching a vacuum zone created in the second hydrodynamic cavitation field, extracting the dissolved gas from the gas-saturated liquid to generate micro bubbles in the liquid.

17. The method of claim 16, wherein the gas is introduced into the liquid in a region of reduced liquid pressure in the first local constriction of flow.

18. The method of claim 16, wherein the local constriction of flow includes one or more of, a baffle, an orifice, a nozzle, and a Venturi tube.

19. The method of claim 16, wherein the cross-sectional area of one or both of, the first local constriction of flow and the second local constriction of flow, is less than about 0.6 times the major diameter of the cross-section of the flow-through channel.

20. The method of claim 16, wherein the gas micro bubbles generated downstream from the second local constriction of flow are one or both of, smaller in size, and more uniform, than the cavitation bubbles formed in the first hydrodynamic cavitation field.

* * * * *